US006432157B1

(12) United States Patent
Nakamura et al.

(10) Patent No.: US 6,432,157 B1
(45) Date of Patent: Aug. 13, 2002

(54) METHOD FOR PREPARING AG-ZNO ELECTRIC CONTACT MATERIAL AND ELECTRIC CONTACT MATERIAL PRODUCED THEREBY

(75) Inventors: Tetsuya Nakamura; Osamu Sakaguchi; Hiroyuki Kusamori; Osamu Matsuzawa; Masahiro Takahashi; Toshiya Yamamoto, all of Kanagawa (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 0 days.

(21) Appl. No.: 09/701,380

(22) PCT Filed: Apr. 20, 2000

(86) PCT No.: PCT/JP00/02584

§ 371 (c)(1),
(2), (4) Date: Nov. 30, 2000

(87) PCT Pub. No.: WO00/65623

PCT Pub. Date: Nov. 2, 2000

(30) Foreign Application Priority Data

Apr. 23, 1999 (JP) ..... 11-117023

(51) Int. Cl.[7] ..... C22C 5/06

(52) U.S. Cl. ..... 75/232; 75/247; 419/21; 419/26; 419/31; 419/48

(58) Field of Search ..... 75/232, 247; 419/21, 419/26, 31, 48

(56) References Cited

U.S. PATENT DOCUMENTS 3,954,459 A * 5/1976 Schreiner et al.
4,115,325 A * 9/1978 Santala et al. ..... 252/514
4,138,251 A * 2/1979 Hirsbrunner et al. ..... 75/234
4,609,525 A * 9/1986 Schreiner et al. ..... 419/6
5,728,194 A * 3/1998 Weise et al. ..... 75/235
5,808,213 A * 9/1998 Weise et al. ..... 75/247
5,841,044 A * 11/1998 Weise et al. ..... 75/232

FOREIGN PATENT DOCUMENTS

| | | |
|---|---|---|
| JP | 49-89192 | 8/1974 |
| JP | 56-139220 | 10/1981 |
| JP | 6-336630 | 12/1994 |

* cited by examiner

*Primary Examiner*—Ngoclan Mai
(74) *Attorney, Agent, or Firm*—Arent Fox Kintner Plotkin & Kahn, PLLC

(57) ABSTRACT

An object of the present invention is to provide a method of producing an Ag—ZnO electric contact material which can uniformly disperse ZnO micrograms in Ag; which maintains low contact resistance; which exhibits enhanced welding resistance and wear resistance; and which is suitable in view of production costs. The method of producing an Ag—ZnO electrical contact material comprises casting Ag and Zn at predetermined proportions and subjecting the resultant Ag—ZnO alloy to internal oxidation so as to disperse ZnO in Ag, the method being characterized in that an Ag—Zn alloy comprising 5–10 wt. % (as reduced to weight of metal) Zn, the balance being Ag, is formed into chips; the chips are subjected to internal oxidation; the internally oxidized chips are compacted to thereby form billets; the billets are pressed and sintered; and subsequently, the sintered billets are extruded, to thereby yield uniform dispersion, in Ag, of ZnO micrograms.

6 Claims, 8 Drawing Sheets

(A)

(B)

(A)

(B)

(A)

(B)

(A)

(B)

METHOD FOR PREPARING AG-ZNO ELECTRIC CONTACT MATERIAL AND ELECTRIC CONTACT MATERIAL PRODUCED THEREBY

TECHNICAL FIELD

The present invention relates to a method of producing an Ag—ZnO electric contact material.

BACKGROUND ART

Conventionally, Ag—ZnO electric contact materials have been known to have considerably low contact resistance, but also to have unsatisfactory welding resistance and wear resistance. Therefore, enhancement of welding resistance and wear resistance of Ag—ZnO electric contact materials is technically important for employment of such materials in make-and-break contacts, such as relays and switches, which are required to possess particularly excellent welding resistance and wear resistance.

A basic approach for enhancing welding resistance and wear resistance of Ag—ZnO electric contact materials resides in uniformly dispersing ZnO micrograms in Ag. In order to attain uniform dispersion of ZnO micrograms, a variety of techniques have been proposed in the fields of powder metallurgy and internal oxidation, in relation to methods of producing Ag—ZnO electric contact materials.

In powder metallurgy, powdered Ag and ZnO are mixed, and the mixture is shaped and sintered. Thus, reduction in the particle size of the powders to be mixed and sufficient mixing of ZnO micrograms result in a certain degree of dispersion. However, in powder metallurgy, the dispersion state of ZnO depends on the particle size of Ag powder and ZnO powder, and, therefore, the target uniformity in the dispersion state of ZnO grains of smaller size is considered to be limited. In addition, since Ag and ZnO have poor sinterability, voids are possibly formed in the produced sintered material, thereby lowering welding resistance and wear resistance in some cases. Thus, make-and-break contacts having highly satisfactory characteristics have never been produced from Ag—ZnO material. Furthermore, powder metallurgy is not economically preferred for producing Ag—ZnO material, in view of generally high production costs.

In internal oxidation, a predetermined amount of an Ag—Zn alloy is sequentially cast, rolled, blanked, and cut, to thereby produce an alloy product of specific shape. The product is heated in an oxidizing atmosphere, to thereby selectively oxidize Zn in the Ag—Zn alloy, causing dispersion of ZnO in Ag. As disclosed in Japanese Patent Publication (kokoku) No. 57-13613, dispersion of ZnO micrograms is attained through internal oxidation concomitant with addition of a third metallic element which causes dispersion of ZnO micrograms.

When ZnO micrograms are dispersed through internal oxidation concomitant with addition of a third metallic element, the ZnO micrograms dispersed in Ag tend to become acicular, and in many cases the acicular oxide is deposited in a streak-like manner. Dispersion becomes more distinct with increasing Zn content. Because this differs from the case of spherical ZnO micrograms dispersed through powder metallurgy, the acicular oxide deposited in a streak-like manner insufficiently enhances welding resistance and wear resistance. In addition, since the third metallic element added to disperse micrograms may affect the characteristics of Ag—ZnO electric contact material, depending on the amount of addition, the amount of the third element to uniformly disperse ZnO micrograms is considered to be limited when conventionally-employed internal oxidation is carried out.

On the basis of the features describe above, Ag—ZnO electric contact materials produced through powder metallurgy have often been employed. However, problems; e.g., controlling of powder particles and sinterability, still remain in the production of Ag—ZnO electric contact material, even when powder metallurgy as described above is employed. In addition, at present, reducing production costs thereof is demanded.

The present invention has been accomplished in view of the foregoing, and an object of the present invention is to provide a method of producing an Ag—ZnO electric contact material, which method can more uniformly disperse, in Ag, ZnO grains of smaller grain size; maintain low contact resistance of the contact material; enhance welding resistance and wear resistance; and produce the material at reasonable cost.

DISCLOSURE OF THE INVENTION

In order to solve the aforementioned problems, the present inventors have improved a method of producing an Ag—ZnO electric contact material including internal oxidation, and have achieved production of an Ag—ZnO electric contact material in which ZnO micrograms are uniformly dispersed at a level which had never before been attained. Accordingly, the invention provides a method of producing an Ag—ZnO electrical contact material which comprises casting a predetermined amount of Ag and Zn and subjecting the resultant Ag—ZnO alloy to internal oxidation to disperse ZnO in Ag, the method being characterized in that an Ag—Zn alloy comprising 5–10 wt. % (as reduced to weight of metal) Zn, the balance being Ag, is formed into chips thereof; the chips are subjected to internal oxidation; the internally oxidized chips are compacted to thereby form billets; the billets are pressed and sintered; and subsequently, the sintered billets are extruded. The present inventors have found that this method can effect highly uniform dispersion, in Ag, of ZnO micrograms.

When the cast Ag—Zn alloy is formed into chips for carrying out internal oxidation, the chips are compacted into billets, and the billets are pressed and sintered. The deposited ZnO assumes a streak-like dispersion state. However, when the billets are further extruded, the streak-like dispersion state of ZnO is converted to a uniform dispersion state of ZnO micrograms. The present inventors assume that the phenomenon occurs due to good wettability of ZnO to Ag.

When billets are formed into material such as wire rods through extrusion, a large shear stress is imposed on the billets in the longitudinal direction during deformation. The deformation during extrusion induces shear of ZnO dispersed in the billets in a streak-like manner, thereby yielding dispersion of ZnO micrograms in Ag. The present inventors have confirmed that a uniform dispersion state of oxide micrograms as yielded in the Ag—ZnO electric contact material of the present invention cannot be attained in an Ag—$SnO_2$ electric contact material; i.e., a material containing an oxide of poor wettability to Ag. $SnO_2$ that is an oxide having poor wettability to Ag cannot be formed into micrograms even though a large amount of shear stress is applied to a billet in the longitudinal direction during extrusion. In contrast, ZnO that is an oxide having good wettability to Ag is subjected to shear stress concomitant with deformation of Ag when a large amount of shear stress is applied to the billet in the longitudinal direction during extrusion. Thus, ZnO deposited in a streak-like manner in the billet is further fractured to form micrograms thereof, thereby yielding a very uniform dispersion state of ZnO micrograms to an extent which has never before been attained.

In order to produce the Ag—ZnO electric contact material of the present invention, particularly, the following process conditions must be satisfied. One condition concerns pressing and sintering to which the billets produced by compacting internally oxidized chips are subjected. The pressing and sintering must be carried out until residual voids and defects in the billets disappear. For example, pressing and sintering of the billets must be performed repeatedly, to thereby sufficiently remove voids and defects in the billets.

The other process condition concerns extrusion which is carried out as a final process. Extrusion must be carried out to a relatively large extrusion ratio. Preferably, the extrusion ratio of the surface area of a billet to that of a produced rod is controlled to 51:1 or higher. The reason for such a high extrusion ratio is that ZnO contained in Ag can be considerably uniformly dispersed in the form of ZnO micrograms by employment of the ratio, thereby enhancing production yield. Typical extruders have an extrusion capacity; i.e., an achievable extrusion ratio, of approximately 350:1. In the method of producing an Ag—ZnO electric contact material, such a high extrusion ratio can also be employed.

The method of the present invention provides an Ag—ZnO electric contact material having a uniform dispersion state of ZnO micrograms in Ag which has never before been attained through a conventional internal oxidation method. Therefore, the material maintains low contact resistance thereof and exhibits enhanced welding resistance and wear resistance. The method of the present invention can produce an Ag—ZnO electric contact material at production costs lower than those involved in powder metallurgy, and the produced Ag—ZnO electric contact material has characteristics approximately equal to those of an Ag—ZnO electric contact material produced through powder metallurgy.

In the method of producing an Ag—ZnO electric contact material of the present invention, when the starting alloy contains only Ag and Zn, an alloy comprising 5–10 wt. % Zn, the balance being Ag, is preferred. When the Zn content is less than 5%, welding resistance and wear resistance cannot be enhanced to a practical level; whereas when the Zn content is in excess of 10%, internal oxidation of the alloy becomes difficult. Even though the alloy is internally oxidized, contact resistance increases considerably and processability of the alloy is degraded.

The present inventors have conducted extensive studies on the aforementioned method of producing an Ag—ZnO electric contact material, and have found that employment of an Ag—Zn—Cu alloy or an Ag—Zn—Cu—Ni alloy as a starting alloy yields an Ag—ZnO electric contact material having more excellent characteristics.

When the aforementioned Ag—ZnO electric contact material is produced from an Ag—Zn—Cu alloy, ZnO micrograms are also uniformly dispersed in Ag. Furthermore, the uniform dispersion state of ZnO micrograms in Ag which is attained in the presence of Cu enhances the contact resistance of the produced electric contact material as compared with a similar dispersion in Ag of only ZnO.

The present inventors have confirmed that when an Ag—ZnO electric contact material produced from only Ag and Zn serving as metallic components is formed into make-and-break contacts, ZnO film is deposited on the contacts after repetition of making and breaking at AC 250V and 10A, thereby elevating contact resistance. Through observation of the contact surface, deposition of layer-like ZnO is recognized at portions damaged by arcing. The inventors have elucidated that the ZnO deposits cause elevated contact resistance.

However, the method of the present invention employing additional Cu provides an Ag—ZnO electric contact material in which increase in contact resistance during making and breaking caused by ZnO is effectively prevented. The assumed mechanism is that Cu forms a solid solution with ZnO and micrograms of the solid solution are uniformly dispersed in Ag. Briefly, Cu which forms a solid solution with ZnO prevents formation of ZnO film on the contacts during making and breaking of the contacts.

The method of the present invention employing additional Cu provides an Ag—ZnO electric contact material which maintains considerably low contact resistance and exhibits excellent welding resistance and wear resistance. The produced electric contact material has a practically sufficient level of characteristics under load conditions of approximately AC 250V and 10A where generally-used relays and switches can operate.

In the method of producing an Ag—ZnO electric contact material of the present invention, when Cu is added to the starting Ag—Zn alloy, an alloy comprising 5–10 wt. % Zn and 0.01–3.00 wt. % Cu. the balance being Ag, is preferred. More preferably, the Ag alloy comprises 7–9 wt. % Zn and 0.20–0.50 wt. % Cu, in that addition of Cu is most effective.

When the Zn content is less than 5 wt. %, welding resistance and wear resistance cannot be enhanced to a practical level; whereas when the Zn content is in excess of 10 wt. %, internal oxidation of the alloy becomes difficult, thereby failing to yield uniform dispersion of ZnO micrograms even in the presence of Cu. In addition, even though a uniform dispersion state of ZnO micrograms is attained, the Zn content in excess of 10 wt. % makes maintenance of a practically low level of contact resistance difficult and reduces processability of the material. When the Cu content is less than 0.01 wt. %, the effect of Cu addition on reduction of the size of ZnO grains is weakened; whereas when the Cu content is in excess of 3.00 wt. %, Cu contained in the ZnO solid solution is readily segregated, thereby depositing CuO on the contacts and elevating contact resistance.

The method of the present invention employing an Ag—Zn—Cu—Ni alloy as a starting alloy provides an Ag—ZnO electric contact material which exhibits more enhanced wear resistance when it is formed into make-and-break contacts.

In general, Ni is known as an additive element for depositing ZnO micrograms during production of an Ag—ZnO electric contact material through internal oxidation. In contrast, the present inventors have confirmed through their research that no particular difference is observed in effect on depositing ZnO micrograms between an Ag—ZnO electric contact material containing Cu and that containing Ni and Cu. However, when the starting alloy contains Ni, the produced electric contact material exhibits enhanced wear resistance under load conditions of approximately AC 250V and 10A where generally-used relays and switches can operate. The assumed mechanism for enhancement of wear resistance is that Ni partially forms a solid solution with ZnO and micrograms of the Ni-containing oxide are uniformly dispersed in Ag.

In the method of producing an Ag—ZnO electric contact material of the present invention, when Cu and Ni are added to the starting Ag—Zn alloy, an alloy comprising 5–10 wt. % Zn, 0.01–3.00 wt. % Cu, and 0.01–0.50 wt. % Ni, the balance being Ag, is preferred. More preferably, the Ag alloy comprises 7–9 wt. % Zn, 0.20–0.50 wt. % Cu, and 0.05–0.20 wt. % Ni, in that the concomitant effect of ZnO, Cu, and Ni attains the optimum balance.

When the Ni content is less than 0.01 wt. %, wear resistance is not effectively enhanced; whereas when the Ni content is in excess of 0.50 wt. %, Ni segregates in the Ag alloy before undergoing internal oxidation, and NiO coarse grains are generated after having undergone internal oxidation. The thus-formed NiO coarse grains cause an increase in contact resistance. In this case, Fe or Co may be used instead of Ni, because Fe and Co also contribute to the enhancement of wear resistance to an extent similar to that attainable by Ni. The Zn content range and the Ni content range are similar to those described above, and repeated description thereof is omitted.

As described hereinabove, an Ag—ZnO electric contact material produced through the method of the present invention has a uniform dispersion state of ZnO micrograms in Ag which has never been attained through a conventional internal oxidation method. Therefore, the material maintains low contact resistance and exhibits enhanced welding resistance and wear resistance.

BEST MODES FOR CARRYING OUT THE INVENTION

Figure 1:
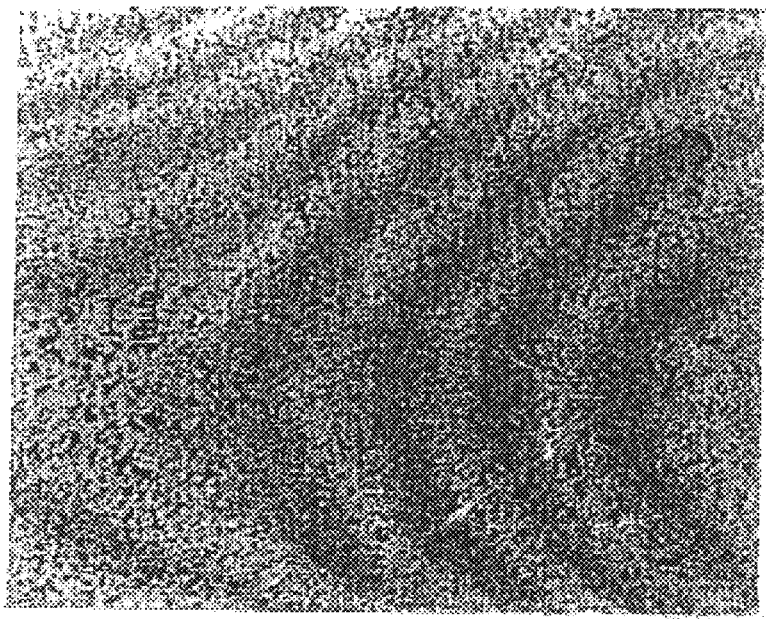
FIG. 1 is a photograph of the cross-sectional metallographical structure of a sample of Working Example 3.

Modes for carrying out the present invention will next be described by way of Examples described below. In Table 1, Working Examples 1 to 17 correspond to Ag—ZnO electric contact materials produced from alloys having compositions (wt. %) shown in Table 1, and Comparative Examples 1 to 8 and Referential Examples 1 to 2 correspond to electric contact materials for comparison with the materials of the Working Examples.

TABLE 1-1

| | Alloy composition before internal oxidation | | | | Cross-sectional Metallographical | Hardness (HV) |
|---|---|---|---|---|---|---|
| | Ag | Zn | Cu | Ni | structure | [before working] |
| Working Ex. 1 | bal. | 6.0 | | | uniform, micrograin | 101.4 |
| Working Ex. 2 | bal. | 7.0 | | | uniform, micrograin | 102.1 |
| Working Ex. 3 | bal. | 8.0 | | | uniform, micrograin | 100.7 [94.2] |
| Working Ex. 4 | bal. | 8.5 | | | uniform, micrograin | 109.3 |
| Working Ex. 5 | bal. | 9.0 | | | uniform, micrograin | 108.7 |
| Working Ex. 6 | bal. | 10.0 | | | uniform, micrograin | 98.3 |
| Working Ex. 7 | bal. | 6.0 | 0.3 | | uniform, micrograin | 100.5 |
| Working Ex. 8 | bal. | 6.0 | 0.5 | | uniform, micrograin | 96.7 |
| Working Ex. 9 | bal. | 7.0 | 0.3 | | uniform, micrograin | 103.2 |
| Working Ex. 10 | bal. | 7.0 | 0.5 | | uniform, micrograin | 101.8 |
| Working Ex. 11 | bal. | 8.0 | 0.3 | | uniform, micrograin | 96.8 |
| Working Ex. 12 | bal. | 8.0 | 0.5 | | uniform, micrograin | 106.9 |
| Working Ex. 13 | bal. | 8.0 | 1.0 | | uniform, micrograin | 105.3 [89.6] |
| Working Ex. 14 | bal. | 8.0 | 2.0 | | uniform, micrograin | 105.6 |
| Working Ex. 15 | bal. | 8.0 | 0.3 | 0.1 | uniform, micrograin | 108.4 [89.9] |
| Working Ex. 16 | bal. | 8.0 | 0.3 | 0.2 | uniform, micrograin | 108.0 |
| Working Ex. 17 | bal. | 8.0 | 0.3 | 0.4 | uniform, micrograin | 108.3 |

TABLE 1-2

| | Alloy composition before internal oxidation | | | | Cross-sectional Metallographical | Hardness (HV) |
|---|---|---|---|---|---|---|
| | Ag | Zn | Cu | Ni | structure | [before working] |
| Comp. Ex. 1 | bal. | 6.0 | | | Streak-like | 86.7 |
| Comp. Ex. 2 | bal. | 8.0 | | | Streak-like | 92.8 |
| Comp. Ex. 3 | bal. | 10.0 | | | Streak-like | 91.7 |
| Comp. Ex. 4 | bal. | 6.0 | 0.3 | | Streak-like | 88.9 |
| Comp. Ex. 5 | bal. | 8.0 | 0.3 | | Streak-like | 99.5 |
| Comp. Ex. 6 | bal. | 8.0 | 2.0 | | Streak-like | 96.3 |
| Comp. Ex. 7 | bal. | 8.0 | 0.3 | 0.2 | Streak-like | 89.9 |
| Comp. Ex. 8 | bal. | 8.0 | 0.3 | 0.4 | Streak-like | 99.0 |
| Ref. Ex. 1 | bal. | 8.0 | | | Dispersion | 77.3 |
| Ref. Ex. 2 | bal. | 8.0 | 0.28 | | Dispersion | 80.5 |

Each of Ag—ZnO electric contact materials of Working Examples 1 to 17 was produced through the following method. An Ag—Zn alloy having a corresponding composition was melted and cast into an ingot, which was hot-extruded to form a wire rod (ϕ=6 mm). The thus-formed wire rod was drawn while the rod was annealed at 700° C., thereby forming a wire rod (ϕ=2 mm). The formed rod was cut to prepare chips having dimensions of ϕ2 mm×2 mmL. The chips were internally oxidized at an oxygen pressure of 5 atm and a temperature of 800 ° C for 48 hours. The thus-treated chips were collected and compacted, to thereby form a columnar billet (ϕ=50 mm).

The columnar billet was placed in a hollow-cylindrical container and pressed in a longitudinal direction of the billet. During pressing, deformation in the longitudinal direction of the billet was allowed, but deformation in a direction perpendicular to the longitudinal direction; i.e., in a columnar side direction, was prohibited, since the columnar billet was held in the container. After completion of pressing, the pressed billet was sintered at 750° C. for four hours. The combination of pressing and sintering was performed four times repeatedly.

The thus-pressed and -sintered billet was hot-extruded to form a wire rod (ϕ=7 mm) (extrusion ratio: approximately 51:1), followed by drawing, to thereby form a wire rod (ϕ=2.3 mm). The wire rod was processed in a header machine, to thereby prepare rivet contacts having a head diameter of 3.5 mm and a head thickness of 1 mm.

Ag—ZnO electric contact materials of Comparative Examples 1 to 2 were produced through a conventional internal oxidation method employed by the present inventors, specifically, an Ag—Zn alloy having a corresponding composition was melted and cast into an ingot, which was hot-extruded to form a wire rod (ϕ=2.3 mm). The thus-formed wire rod was internally oxidized at an oxygen pressure of 5 atm and a temperature of 800° C. for 48 hours. Ag—ZnO electric contact materials of Referential Examples 1 and 2 were produced through powder metallurgy. Specifically, powders of Ag, ZnO, and CuO were weighed and mixed, so as to attain a composition (as reduced to metal) shown in Table 1, and the mixture was sintered at 750° C. and a pressure of 200 tons.

Figure 2:
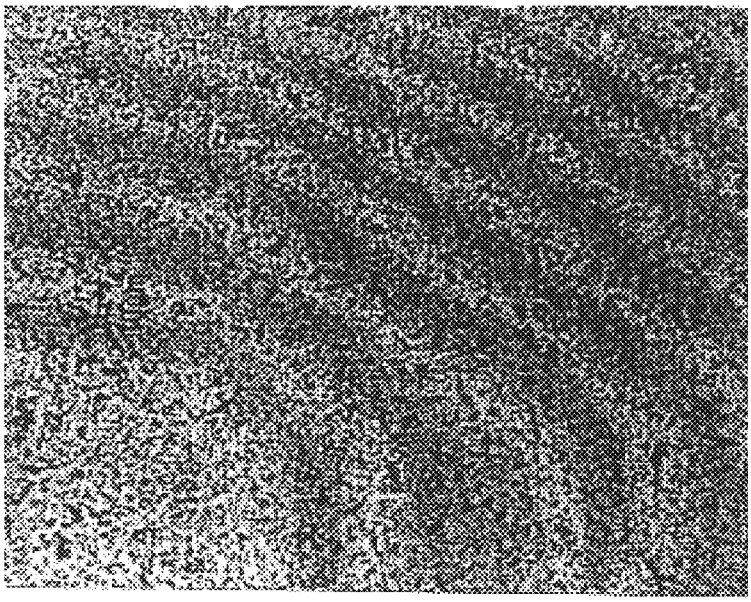
FIG. 2 is a photograph of the cross-sectional metallographical structure of a sample of Working Example 11.
Figure 3:
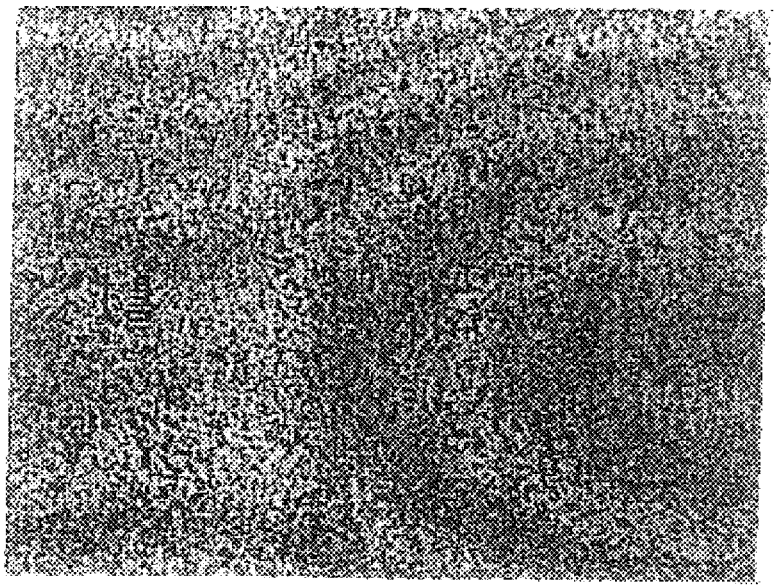
FIG. 3 is a photograph of the cross-sectional metallographical structure of a sample of Working Example 16.
Figure 4:
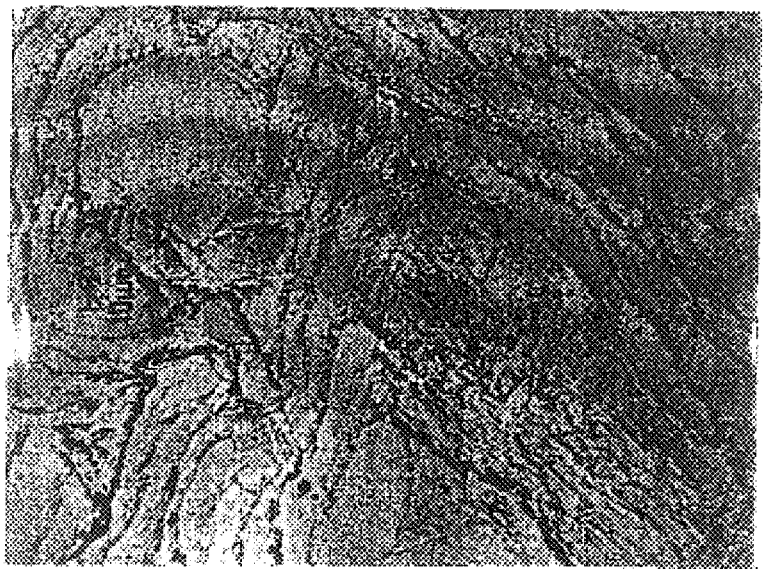
FIG. 4 is a photograph of the cross-sectional metallographical structure of a sample of Comparative Example 2.
Figure 5:
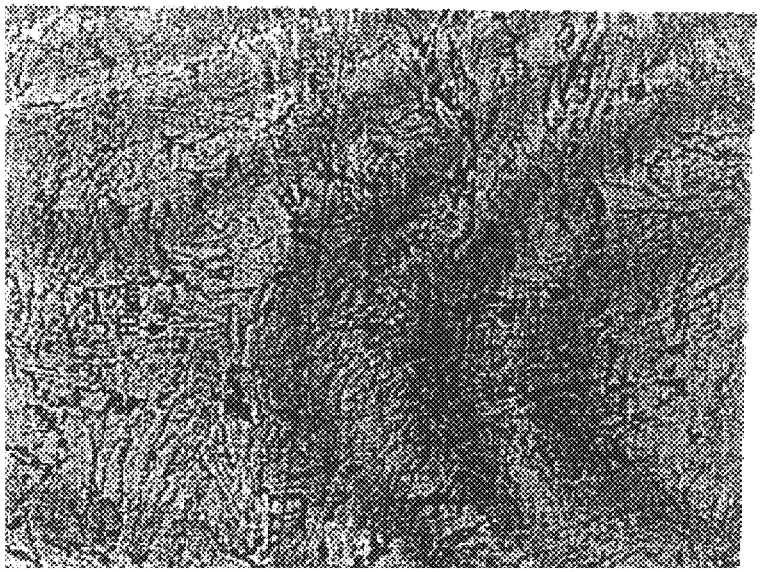
FIG. 5 is a photograph of the cross-sectional metallographical structure of a sample of Comparative Example 5.
Figure 6:
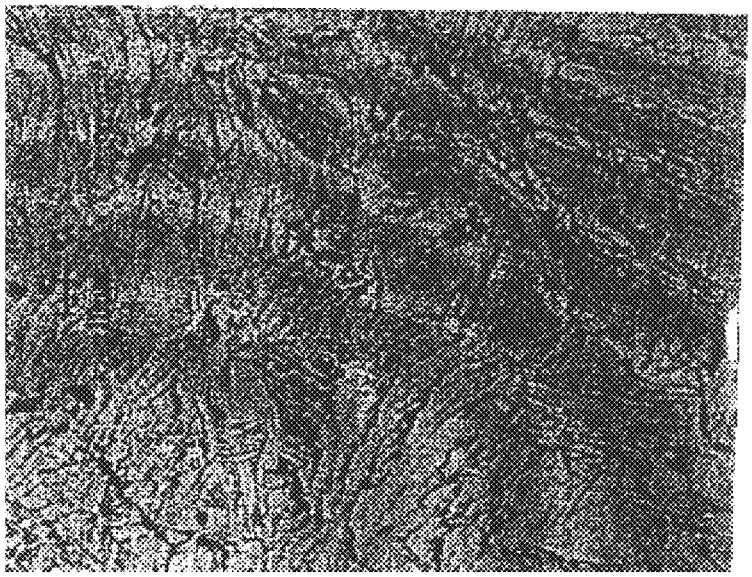
FIG. 6 is a photograph of the cross-sectional metallographical structure of a sample of Comparative Example 7.
Figure 7:
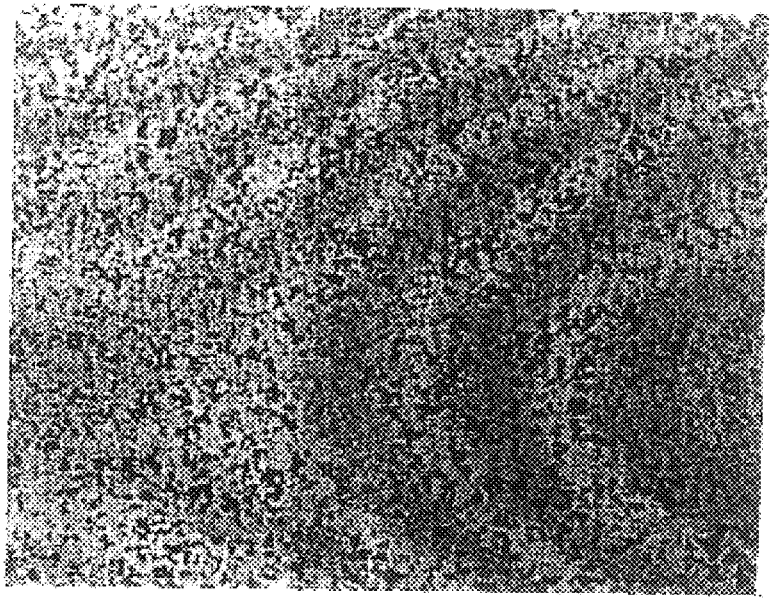
FIG. 7 is a photograph of the cross-sectional metallographical structure of a sample of Referential Example 1.
Figure 8:
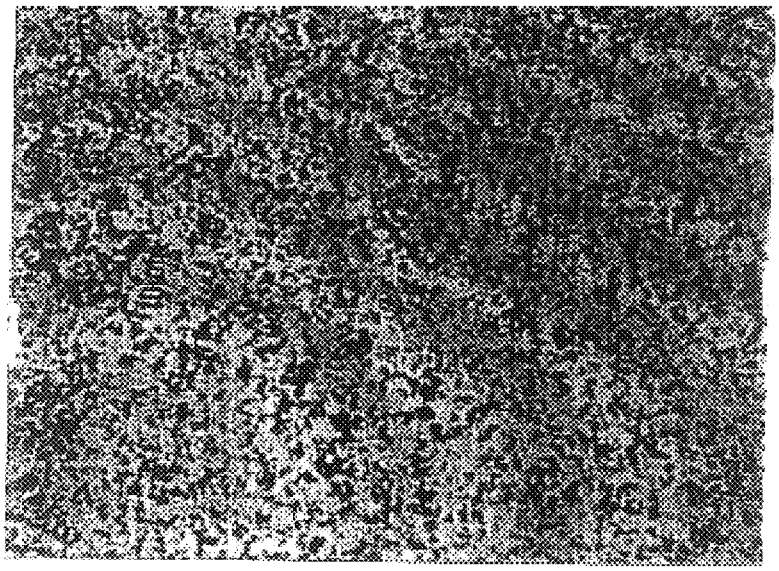
FIG. 8 is a photograph of the cross-sectional metallographical structure of a sample of Referential Example 2.

Metallographical structure and physical properties of samples of the Working Examples will next be described. As typical examples, FIGS. 1 to 3 show photographs of the cross-sectional metallographical structures of samples, after being extruded, of Working Examples 3, 11, and 16, respectively. FIGS. 4 to 6 show photographs of the cross-sectional metallographical structures of samples of Comparative Examples 2, 5, and 7, respectively. FIGS. 7 and 8 show photographs of the cross-sectional metallographical structures of samples of Referential Examples 1 and 2, respectively. These cross-sectional images were observed under a metallographical microscope (×400).

In addition, Table 1 shows Vicker's hardness (load 200 gf) at a cross section of the electric contact material samples of the Working Examples, Comparative Examples, and Referential Examples. Hardness inserted in [] shows the value obtained before the corresponding material undergoes extrusion.

Metallographical structure images show that samples of Working Examples 3, 11, and 16, immediately before undergoing extrusion, assumed a streak-like dispersion state of oxides such as ZnO in Ag similar to that seen in images shown in FIGS. 4 to 6. FIGS. 1 to 3 confirm that the streak-like dispersion state was converted to a highly uniform dispersion state of oxide micrograms after performance of extrusion. The dispersion feature of samples of other Working Examples shown in Table 1 is similar to the feature described above. In FIGS. 4 to 6, which show metallographical structures of samples of the Comparative examples, a streak-like dispersion state of ZnO was confirmed. FIGS. 6 and 7 reveal that ZnO is dispersed in Ag to a certain extent in uniformity for samples of Referential Examples produced through powder metallurgy. However, FIGS. 1 to 3 reveal that the dispersion state of oxides is more uniform and the grain size of oxides is smaller in samples of Working Examples as compared with samples of Referential Examples.

As is clear from Table 1, Vicker's hardness of samples of Working Examples is considerably higher than that of samples of Comparative Examples and Referential Examples. The results reveal that electric contact materials of Working Examples were strengthened by dispersion of ZnO micrograms.

The results of the durability test of rivet contacts will next be described. The durability test was performed under TV-8 conditions defined by the TV standards shown in Table 2. Rivet contacts, incorporated into a relay, to be tested were produced from the contact material of Comparative Example 11. Similar rivet contacts for comparison (Referential Example 3) were produced from a contact material which was prepared from Ag-12 wt. % Cd alloy through internal oxidation as employed in the Comparative Examples. The cross-sectional metallographical structure of the electric contact material of Referential Example 3 shows a comparatively uniform dispersion state of oxide micrograms.

TABLE 2

| Durability test conditions | |
|---|---|
| Test voltage | AC 120 V |
| Initial current | 117 A |
| Steady state current | 8 A |
| Load | Tungsten filament lamp |
| Making–breaking frequency | 10/minute |

Figure 9:
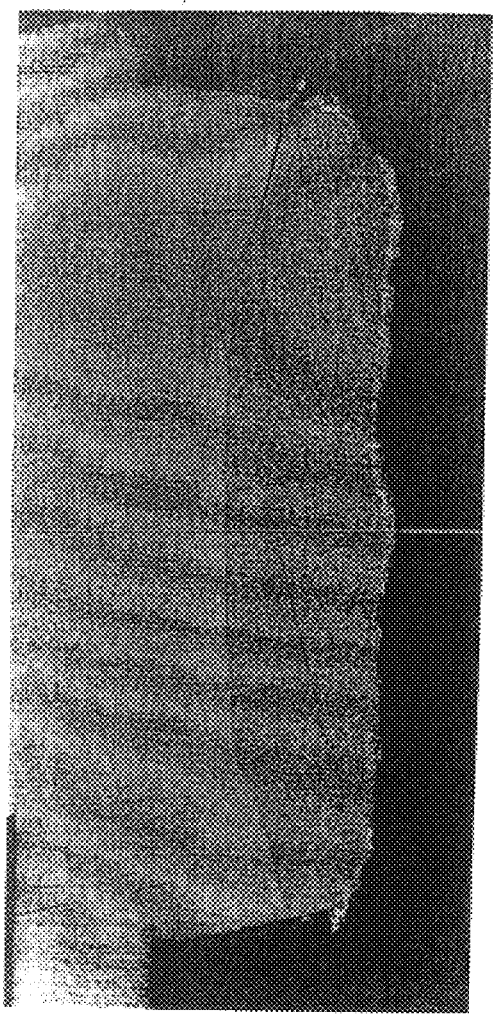
FIG. 9 is a photograph (×50) of the cross-sectional metallographical structure of a sample of Working Example 11 after undergoing a durability test.
Figure 9:
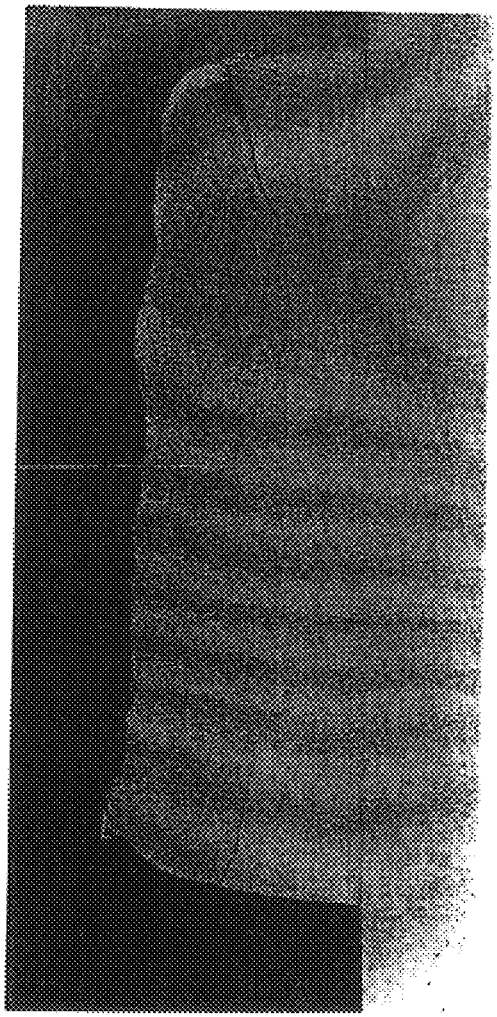
Figure 10:
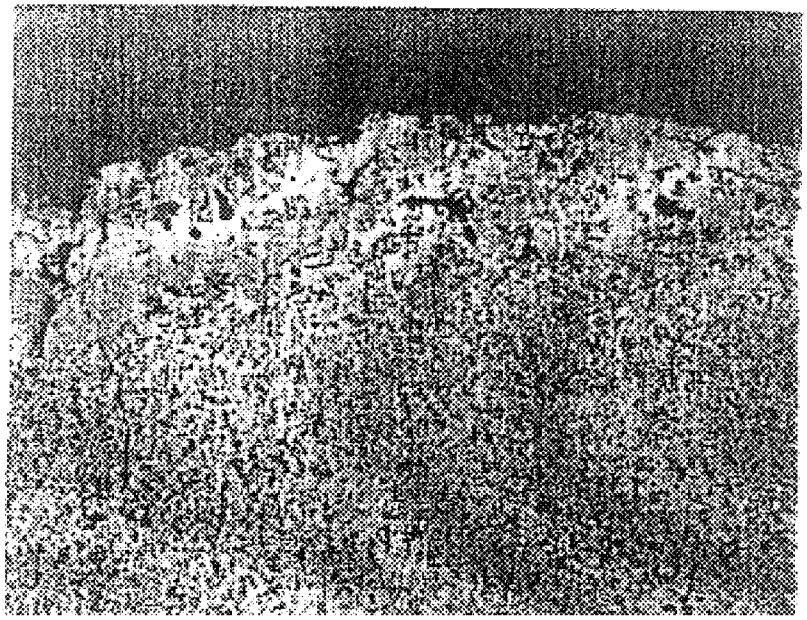
FIG. 10 is a photograph (×400) of the cross-sectional metallographical structure, showing an enlarged portion of FIG. 9.
Figure 10:
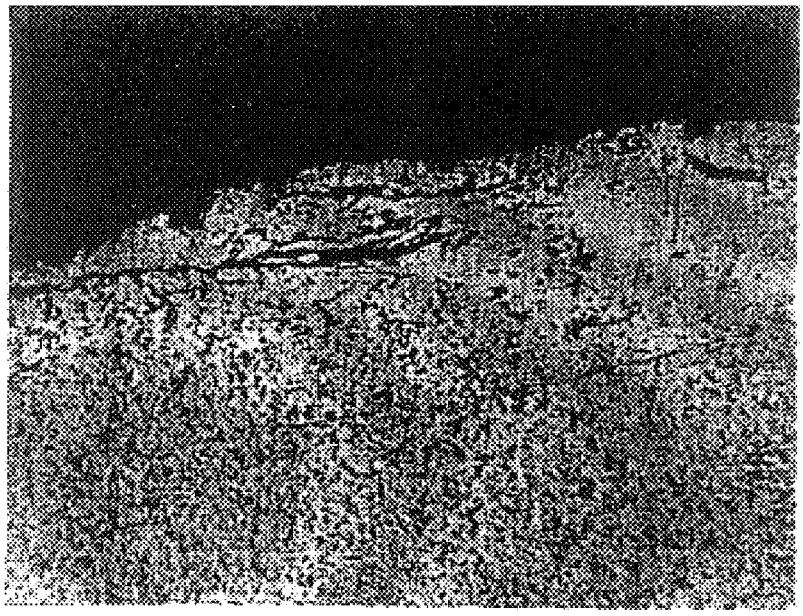
Figure 11:
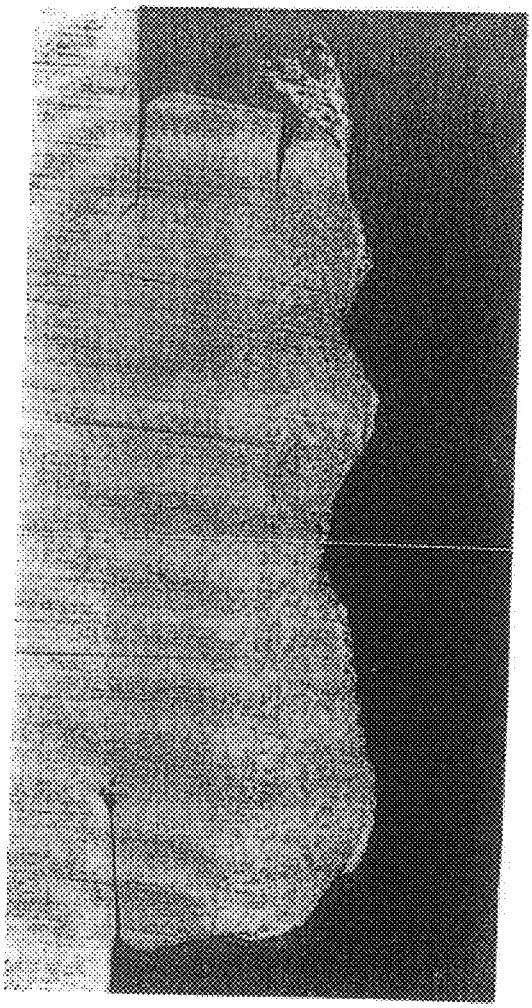
FIG. 11 is a photograph (×50) of the cross-sectional metallographical structure of a sample of Referential Example 3 after undergoing a durability test.
Figure 11:
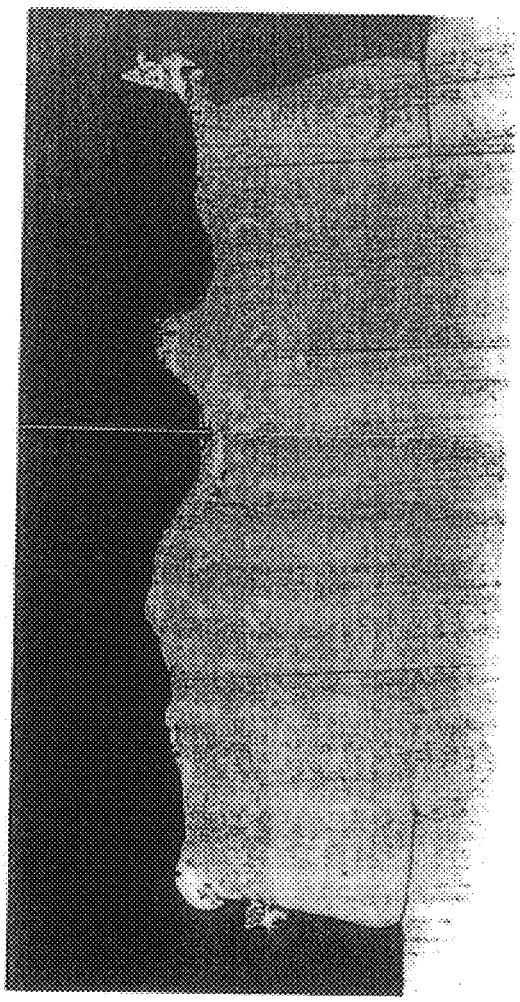
Figure 12:
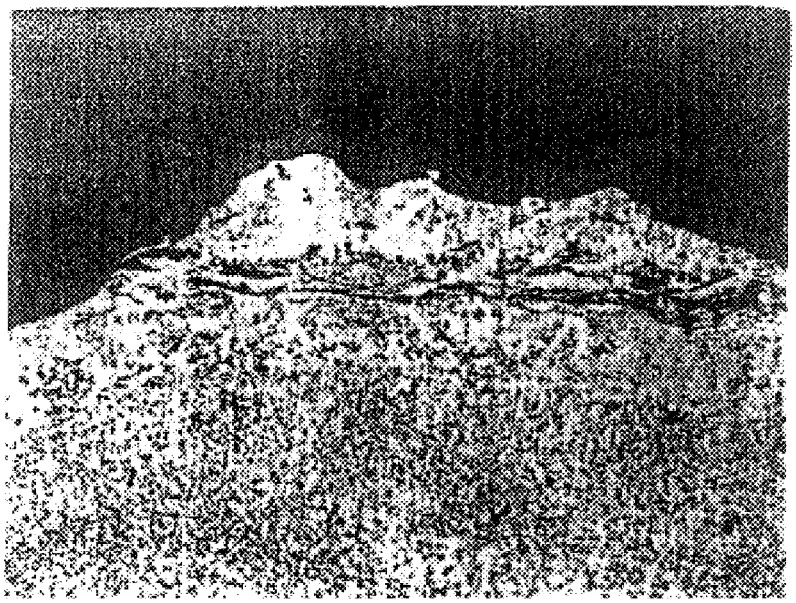
FIG. 12 is a photograph (×400) of the cross-sectional metallographical structure, showing an enlarged portion of FIG. 11.
Figure 12:
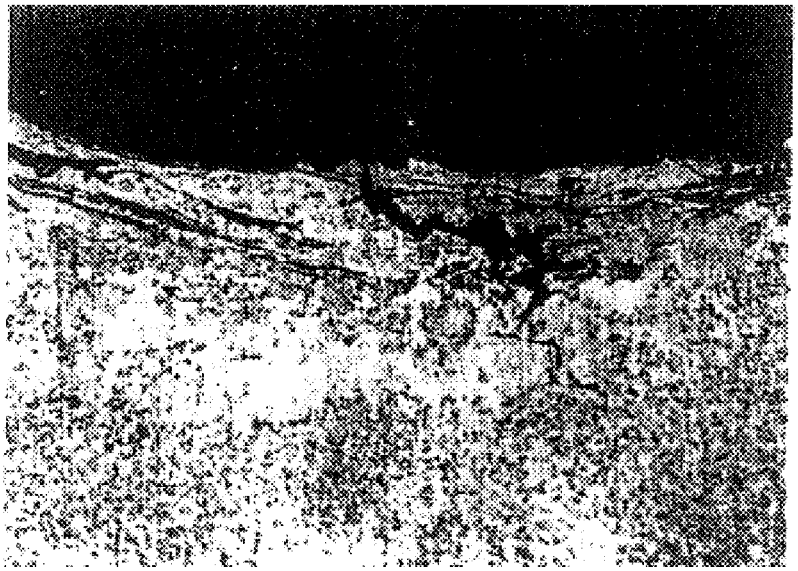

After a cycle of making and breaking had been carried out 40,000 times under the conditions shown in Table 2, the cross-sectional metallographical structure of rivet contacts of Working Example 11 and that of rivet contacts of Referential Example 3 were observed. The results are shown in FIGS. 9 to 12. FIGS. 9 (×150) and FIGS. 10 (×400) show the cross-sectional metallographical structure of rivet contacts of Working Example 11, and FIGS. 11 (×50) and FIGS. 12 (×400) show the cross-sectional metallographical structure of rivet contacts of Referential Example 3. Symbol (a) denotes a movable-side contact and symbol (b) denotes a fixed-side contact. The surfaces of contacts of Working Example 11 remained smooth, as shown in FIGS. 9(*a*) and 9(*b*); whereas the surfaces of contacts of Referential Example 3 were considerably roughened with some defects, as shown in FIGS. 11(*a*) and 11(*b*). FIGS. 10 and 12 show enlarged images of the contact portions. As shown in FIGS. 10, rivet contacts of Working Example 11 maintained good metallographical conditions with few deposits of a streak-like oxide (black portions in the photographs); whereas, as shown in FIGS. 12, rivet contacts of Referential Example 3 assumed degraded contact surface portions in which oxides (black portions in the photographs) were deposited in a streak-like manner.

The results of the durability test reveal that the electric contact material of Working Example 11 exhibits excellent welding resistance and wear resistance as compared with a Cd-containing electric contact material, which has been employed as a suitable contact material among other conventional contact materials.

Industrial Applicability

The method of producing an Ag—ZnO electric contact material can uniformly disperse ZnO micrograms in Ag and can enhance welding resistance and wear resistance. In addition, production costs can be reduced.

What is claimed is:

1. A method of producing an Ag—ZnO electrical contact material comprising casting Ag and Zn in predetermined proportions and subjecting the resultant Ag—ZnO alloy to internal oxidation so as to obtain a Ag matrix containing finely and uniformity disperse ZnO, the method comprising the steps of:

a) melting and casting an Ag—Zn alloy to obtain a cast alloy comprising 5–10 wt. % Zn, the balance being Ag;

b) forming the cast alloy into chips;

c) internally oxidizing the chips to form billets in which ZnO is deposited in the Ag matrix in a streak-like dispersion state;

d) collecting and introducing the chips of step c) into a mold and pressing the mold to produce billets;

e) sintering and pressing the billets several times;

f) extruding the billets to form a wire rod at an extrusion ratio of 51:1 or higher, wherein the ratio is based on the surface area of the billet to the surface area of the wire rod being formed during the extruding; and g) converting the streak-like dispersion state of ZnO into a particulate state by a shearing force generated during the extruding step to finely and uniformity disperse the ZnO in the Ag matrix.

2. A method of producing an Ag—ZnO electrical contact material comprising casting Ag, Zn and Cu in predetermined proportions and subjecting the resultant Ag—ZnO alloy to internal oxidation to form a Ag matrix containing finely and uniformity disperse ZnO, the method comprising the steps of:

a) melting and casting an Ag—Zn—Cu alloy to obtain a cast alloy comprising 5–10 wt. % Zn and 0.01–3.00 wt. % Cu for a total metal weight percent, the balance being Ag;

b) forming the cast alloy into chips;

c) internally oxidizing the chips to form billets in which ZnO is deposited in the Ag matrix in a streak-like dispersion state;

d) collecting and introducing the chips of step c) into a mold and pressing the mold to produce billets;

e) sintering and pressing the billets several times;

f) extruding the billets to form a wire rod at an extrusion ratio of 51:1 or higher, wherein the ratio is based on the surface area of the billet to the surface area of the wire rod being formed during the extruding; and g) converting the streak-like dispersion state of ZnO into a particulate state by a shearing force generated during the extruding step to finely and uniformity disperse the ZnO in the Ag matrix.

3. A method of producing an Ag—ZnO electrical contact material comprising casting Ag, Zn, Cu and Ni in predetermined proportions and subjecting he resultant Ag—ZnO alloy to internal oxidation to obtain a Ag matrix containing finely and uniformity disperse ZnO, the method comprising the steps of:

a) melting and casting an Ag—Zn—Cu—Ni alloy comprising 5–10 wt. % Zn, 0.01–3.00 wt. % Cu, and 0.01–0.50 wt. % Ni for a total metal weight percent, the balance being Ag;

b) forming the cast alloy into chips;

c) internally oxidizing the chips to form billets in which ZnO is deposited in the Ag matrix in a streak-like dispersion state;

d) collecting and introducing the chips of step c) into a mold and pressing the mold to produce billets;

e) sintering and pressing the billets several times;

f) extruding the billets to form a wire rod at an extrusion ratio of 51:1 or higher, wherein the ratio is based on the surface area of the billet to the surface area of the wire rod being formed during the extruding; and g) converting the streak-like dispersion state of ZnO into a particulate state by a shearing force generated during the extruding step to finely and uniformily disperse the ZnO in the Ag matrix.

4. An electrical contact material produced through a method of producing an Ag—ZnO electrical contact material as recited in claim 1.

5. An electrical contact material produced through a method of producing an Ag—ZnO electrical contact material as recited in claim 2.

6. An electrical contact material produced through a method of producing an Ag—ZnO electrical contact material as recited in claim 3.

* * * * *

UNITED STATES PATENT AND TRADEMARK OFFICE

CERTIFICATE OF CORRECTION

PATENT NO. : 6,432,157 B1
DATED : August 13, 2002
INVENTOR(S) : Nakamura et al.

It is certified that error appears in the above-identified patent and that said Letters Patent is hereby corrected as shown below:

Title page, Item [54] and Column 1, lines 1-4,
Please change the title from "METHOD FOR PREPARING AG-ZNO ELECTRIC CONTACT MATERIAL AND ELECTRIC CONTACT MATERIAL PRODUCED THEREBY" to -- METHOD FOR PREPARING Ag-ZnO ELECTRIC CONTACT MATERIAL AND ELECTRIC CONTACT MATERIAL PRODUCED THEREBY --.

Signed and Sealed this

First Day of April, 2003

JAMES E. ROGAN
*Director of the United States Patent and Trademark Office*